US005147171A

United States Patent [19]

Murray et al.

[11] Patent Number: 5,147,171

[45] Date of Patent: Sep. 15, 1992

[54] SIDE SHIFT CARRIAGE FOR A LIFT MAST

[75] Inventors: Kenneth R. Murray, Chardon; William T. Yarris, Twinsburg, both of Ohio

[73] Assignee: Caterpillar Industrial Inc., Mentor, Ohio

[21] Appl. No.: 735,736

[22] Filed: Jul. 25, 1991

[51] Int. Cl.[5] ..... B66F 9/14

[52] U.S. Cl. ..... 414/671; 414/667

[58] Field of Search ..... 414/664–671

[56] References Cited

U.S. PATENT DOCUMENTS

| | | | |
|---|---|---|---|
| 2,958,436 | 11/1960 | Skutle et al. | 414/667 |
| 2,985,328 | 5/1961 | Fitch | 414/667 |
| 3,512,671 | 5/1970 | Morocco | 414/671 |
| 3,586,192 | 6/1971 | Goodacre | 414/667 X |
| 3,734,327 | 5/1973 | Ellis, Jr. | 414/667 |
| 3,974,927 | 8/1976 | Schuster | 414/667 |
| 4,392,773 | 7/1983 | Johannson | 414/667 |
| 4,406,575 | 9/1983 | Gaibler | 414/667 |
| 4,607,997 | 8/1986 | Asano | 414/667 |
| 5,033,934 | 7/1991 | Emilio | 414/667 |
| 5,052,881 | 10/1991 | Keffeler et al. | 414/667 X |

FOREIGN PATENT DOCUMENTS

| | | | |
|---|---|---|---|
| 262891 | 6/1968 | Austria | 414/667 |
| 325889 | 8/1989 | European Pat. Off. | 414/667 |
| 3515524 | 11/1876 | Fed. Rep. of Germany | 414/671 |
| 2716704 | 10/1978 | Fed. Rep. of Germany . | |
| 2376817 | 9/1978 | France | 414/667 |
| 1011496 | 4/1983 | U.S.S.R. | 414/671 |

*Primary Examiner*—David A. Bucci
*Attorney, Agent, or Firm*—Alan J. Hickman

[57] ABSTRACT

A side shiftable carriage assembly has a carriage frame and a side shift frame. A bracket arrangement connects the side shift frame to the carriage frame for slidable movement in directions transverse uprights of a lift mast. The bracket arrangement has spaced apart first and second support and stop portions which position and axially align first and second jacks at a location closely adjacent first elongated guide and support rail members of the carriage and side shift frames. A fastening device removably connects the first and second jacks to the first and second stop portions, respectively. A restraining member maintains the first and second jacks on the first and second support portions. Rods of the first and second jacks abuttingly engageable with a force reaction device connected to the carriage frame moves the side shift frame transversely along the carriage frame. The side shiftable carriage assembly is particularly suited for use on a lift mast of a material handling vehicle.

17 Claims, 5 Drawing Sheets

SIDE SHIFT CARRIAGE FOR A LIFT MAST

TECHNICAL FIELD

This invention relates to a side shiftable carriage assembly having a pair of opposed jacks which are removably mounted on the side shiftable frame at a location closely adjacent an elongated support rail member of the side shift frame so that visibility through the side shift carriage is maximized and serviceability is improved.

BACKGROUND ART

Side shiftable carriage assemblies for lift masts have been utilized for decades to enable the operator of a material handling vehicle upon which the lift mast is mounted to be able to move a load or position the carriage transversely relative to the lift mast without moving the vehicle. Such a feature facilitates ease of operation for the operator and increases the speed of the loading cycle with reduced operator effort. A typical side shift carriage, such as shown in U.S. Pat. No. 4,392,773 dated Jul. 12, 1983, to Richard J. Johannason utilizes a fluid operated jack for shifting the side shift frame transversely relative to the spaced apart uprights of the lift mast. Typically, the side shift jack is located in the window defined by the rectangular structure of the side shift frame. Placing the side shift jack at such a location, at times during operation of the carriage and lift mast, may reduce the vehicle operator's ability to carefully position the carriage relative to a load to be lifted. This reduction in ability may occur during both elevational and transverse movement of the side shiftable carriage frame.

Many attempts have been made to improve visibility through the carriage and side shift carriage frames. One such attempt is shown in Offenlegungsschrift 2,716,704 to Otmar Kaup which published on Oct. 19, 1978. The Kaup reference teaches the placement of a pair of axially aligned side shift jacks which are mounted on a support plate anchored to the carriage frame. The forks are slidably supported on the cylindrical housings of the jacks by a pair of guide members. Actuation of the jacks of Kaup moves a support member connected to the guide members and causes the forks to translate along the cylinders in a side shiftable manner. Due to this construction, the weight of the forks and any load on the forks is passed radially through the cylinders and the cylinder rods. This causes deflection, distortion, and bending of the cylinders and their rods which ultimately results in fluid leakage and premature failure. The support plate connecting the cylinders together adds undesirable bulk to the apparatus which reduces the maximum amount of visibility of the vehicle operator.

Because the cylinders of Kaup are permanently attached to the support plate, the potential for removing, repairing and replacing an individual jacks is prevented. Thus, if one jack requires repair or replacement, both jacks and the support plate connecting the jacks together would have to be replaced. Further, because the individual guide members are mounted on the cylindrical housings, a high quality cylindrical steel housing with a good quality finish is required. This is necessary in order to achieve smooth sliding motion of the forks. Since the forks are transversely offset from the support guide members, any load placed on the forks will tend to cock the forks in a plane of the jack axis. The additional moment of force acting on the cylinders will increase the bending loads on the jacks and thus cause premature wear and failure of the jacks and associated components.

Since the Kaup patent does not have a side shiftable frame mounted on the carriage frame, the potential for early hour failures is great. This is primarily due to the fact that the guide length of the support guide members is relatively short compared to the long length of guide provided on a typical side shiftable frame such as shown in Johannason.

In view of the above, it is desirable to provide a side shiftable carriage assembly which has good visibility, compact construction, and good load resisting characteristics. It is also desirable to provide a side shiftable carriage assembly that is durable but easily serviced and disassembled. To achieve this, it is necessary to provide ease of removal and installation of the shift jacks thereon.

The present invention is directed to overcoming one or more of the problems as set forth above.

DISCLOSURE OF THE INVENTION

In one aspect of the present invention, a side shiftable carriage assembly for a lift mast having a pair of spaced elevationally oriented uprights is provided. The side shiftable carriage assembly has a carriage frame which has an elongated guide rail member. The carriage frame is connectable to an elevationally movable along the pair of uprights of the lift mast. The first elongated guide rail member has spaced apart ends and extends transversely relative to the pair of uprights. A side shift frame having a first elongated support rail member is provided. A bracket arrangement slidably connects the side shift frame to the carriage frame and releasably connects housings of first and second jacks to the side shift frame at spaced apart locations along the first elongated support rail member. The bracket arrangement maintains the first elongated guide rail substantially parallel to the first elongated support rail member and the longitudinal axis of the first and second jacks in axial alignment with each other and substantially parallel to the first elongate guide rail member. A force reaction device is connected to the carriage frame and extends from a location between the spaced apart ends of the first elongated guide rail member transversely relative to the first elongated guide rail. The force reaction device has opposite sides and the rod of the first jack is engaged with one of the opposite sides and the rod of the second jack is engaged with the other of the opposite sides. The side shift frame is movable along the carriage frame in response to a force being applied by one of the rods of the first and second jacks to the force reaction device.

In another aspect of the present invention, lift mast having a pair of spaced apart elevationally oriented uprights is provided. A carriage frame having a first elongated guide rail member is connected to and elevationally movable along the upright pair. The first elongated guide rail member has spaced apart ends and the first elongated guide rail member extends transversely relative to the pair of uprights. A bracket arrangement slidably connects a side shift frame having a first elongated support rail member to the carriage frame and releasably connects housings of first and second jacks to the side shift frame at spaced apart locations along the first elongated support rail member. The bracket arrangement maintains the first elongated guide rail member substantially parallel to the first elongated support rail member and a longitudinal axis of the first and second jacks in axial alignment with each other and substantially parallel to the first elongated guide rail member. The bracket arrangement has first and second transversely spaced apart support portions and first and second spaced apart stop portions. The first and second jacks are releasably connected to the first and second stop portions, respectively, and are supported on the first and second support portions, respectively. A force reaction device, which is connected to the carriage frame extends transversely relative to the first elongated guide rail member from a location between the spaced apart ends of the first elongated guide rail member. The force reaction device has opposite sides and a rod of the first jack is engaged with one engaged with the other of the opposite sides. The side shift frame is movable along the carriage frame in response to a force being applied by one of the rods of the first and second jacks to the force reaction device.

The bracket arranged supports the first and second jacks at a location closely adjacent the guide rail members and therefore maximizes the visibility of the operator through the window of the side shiftable carriage assembly Because the first and second jacks are supported by the support and stop portions and are free from connection to the forks, the potential for any load on the forks being transferred to the first and second jacks is minimal. Therefore, the life of the jacks is maximized.

Since the bracket arrangement releasably connects the jacks to the side shift frame the jacks may be easily removed or attached as needed in a very brief period of time. Since the rods of the jacks are free from connection and only apply a force to the force reaction means, the potential for bending, breaking, and the like has been eliminated.

A restraining member holds the jacks radially in position on the cradle of the bracket arrangement but allows for flexing and the like during heaving loading so that radial stress on the cylinder rod and the like is prevented. Therefore, longevity of service life is provided. Because the cylinder rods face each other, they are able to engage a common force reaction means which reduces additional components and of course reduces the cost and complexity of the side shiftable carriage construction.

BEST MODE FOR CARRYING OUT THE INVENTION

Figure 1:
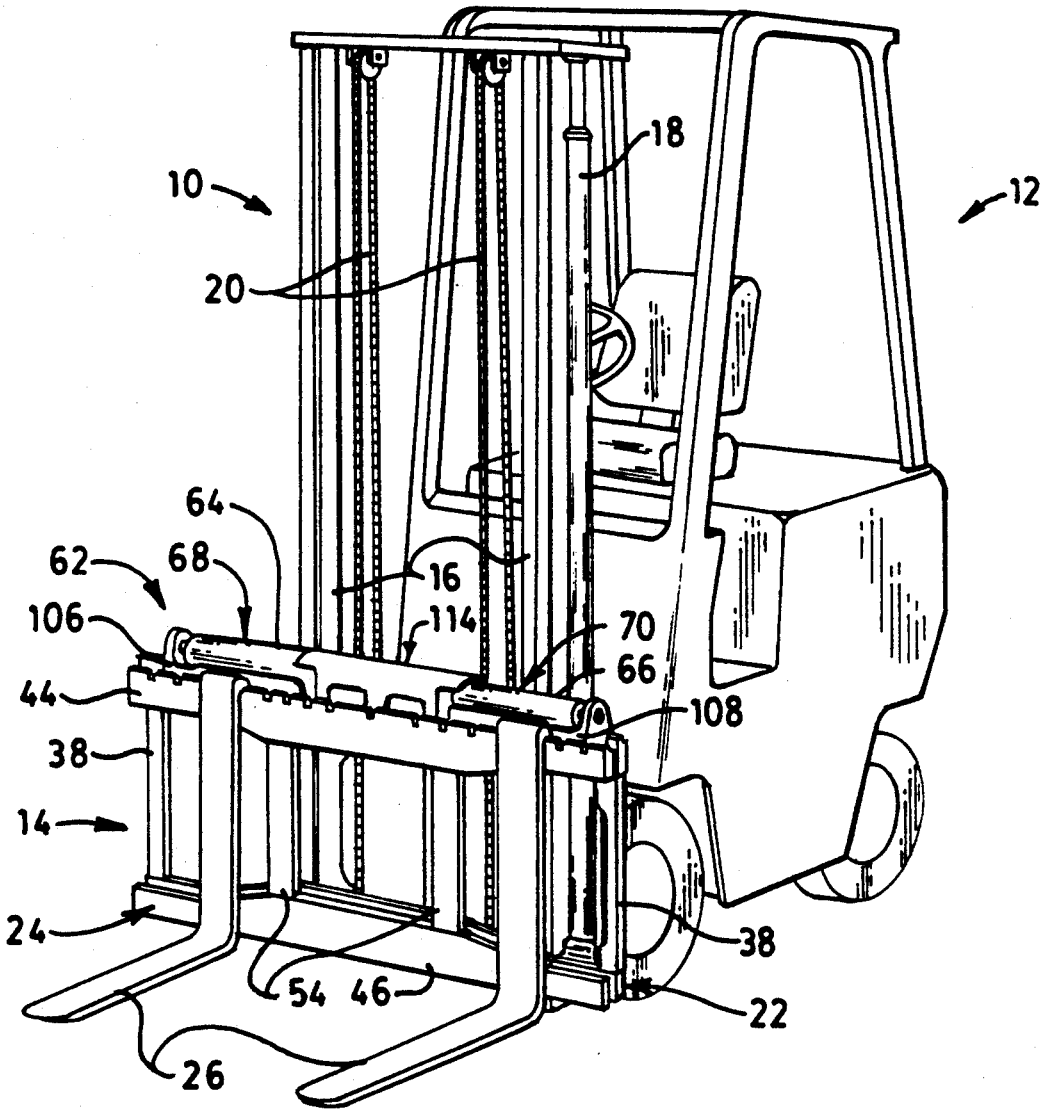
FIG. 1 is a diagrammatic isometric view showing an embodiment of a side shiftable carriage assembly of the present invention mounted on a lift mast assembly of a material handling vehicle.

With reference to the drawings, and particularly FIG. 1, a lift mast 10 of conventional construction is shown mounted on the front end of a material handling vehicle 12. A side shiftable carriage assembly 14 is mounted on a pair of uprights 16 of the lift mast 10. The side shiftable carriage assembly 14 is elevationally movable along the uprights 16 in response to extension and retraction of a lift jack 18 by virtue of a chain and reeving arrangement 20 of conventional and well known design. The construction of the lift mast 10 and the operation thereof is well known in the art and therefor will not be discussed in any greater detail.

Figure 2:
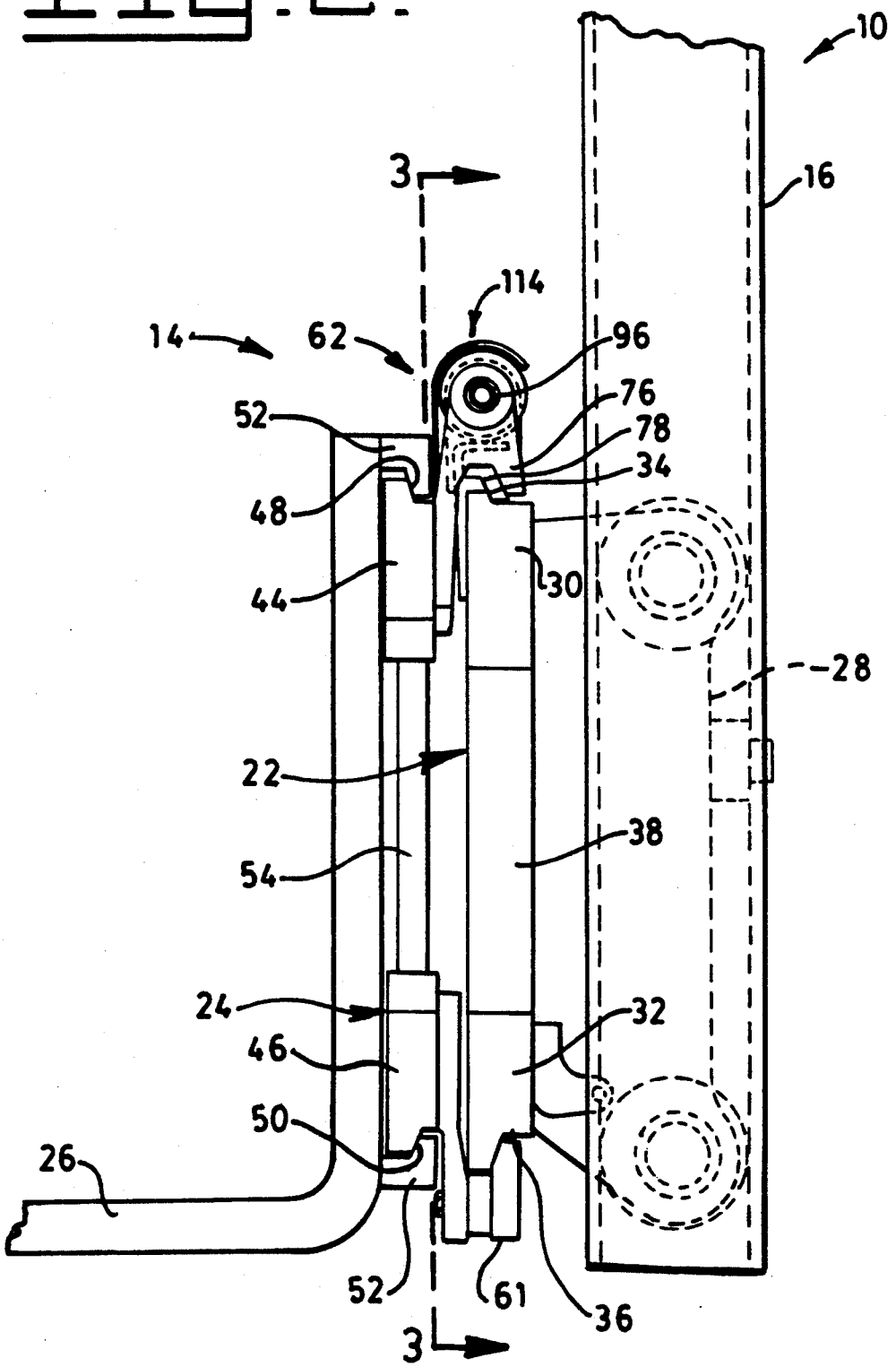
FIG. 2 is a diagrammatic side elevational view of the side shiftable carriage assembly with a portion of the lift mast shown.
Figure 3:
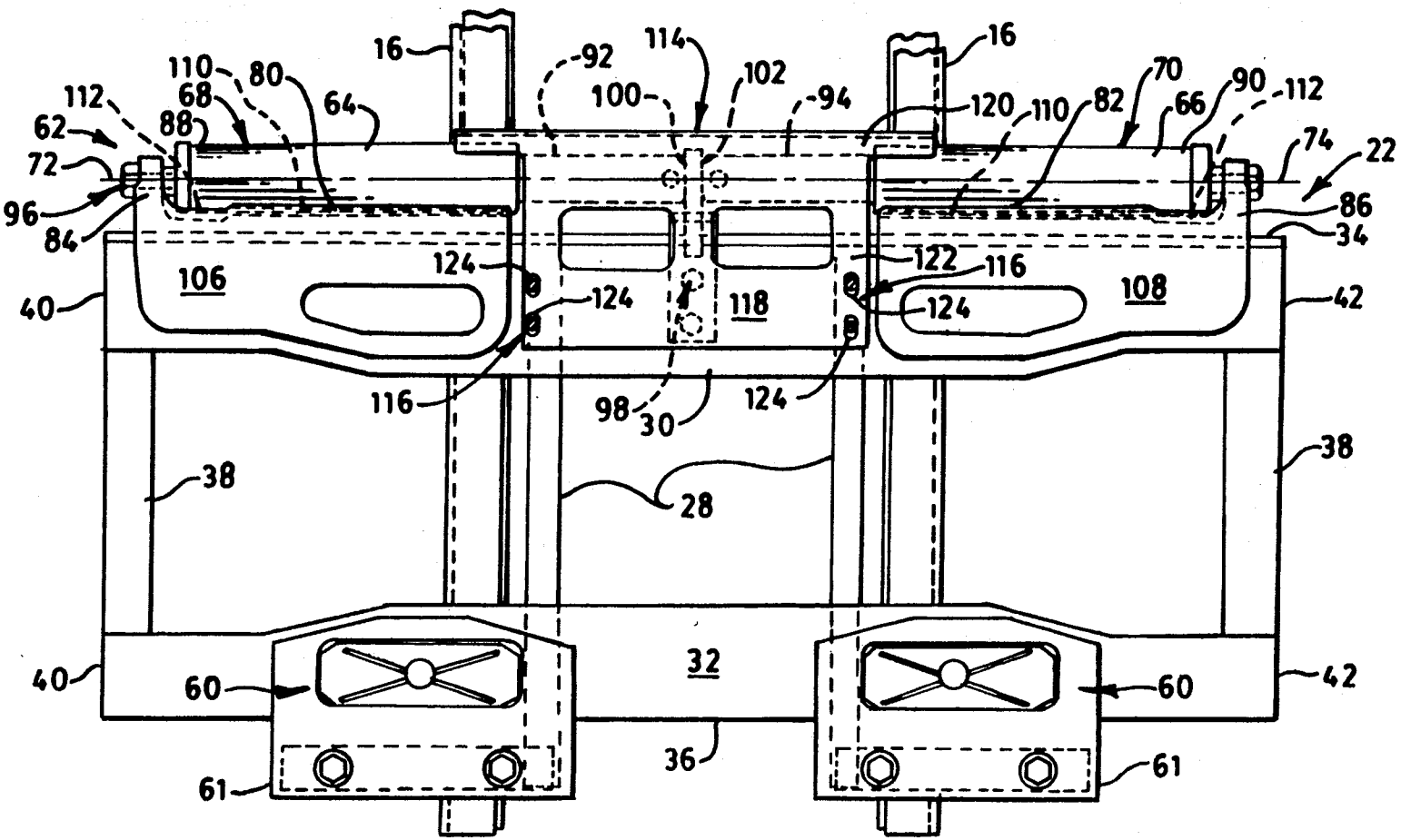
FIG. 3 is a cross sectional view taken along lines 3—3 of FIG. 2 showing the carriage assembly and related components in greater detail.
Figure 4:
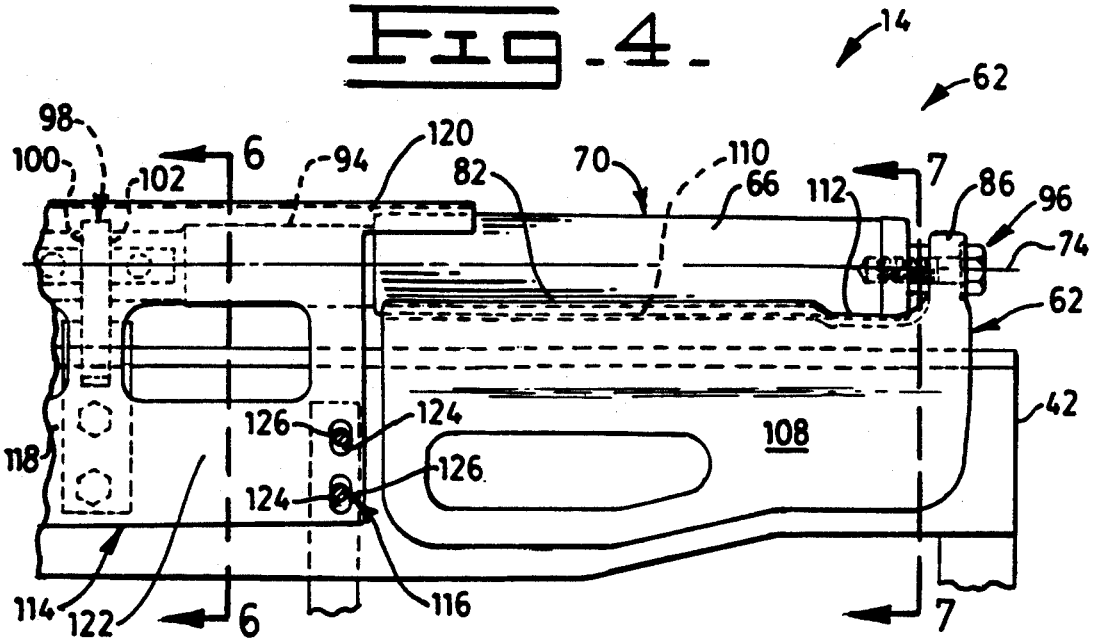
FIG. 4 is a diagrammatic enlarged detail of a portion of the side shiftable carriage assembly of FIG. 3.
Figure 5:
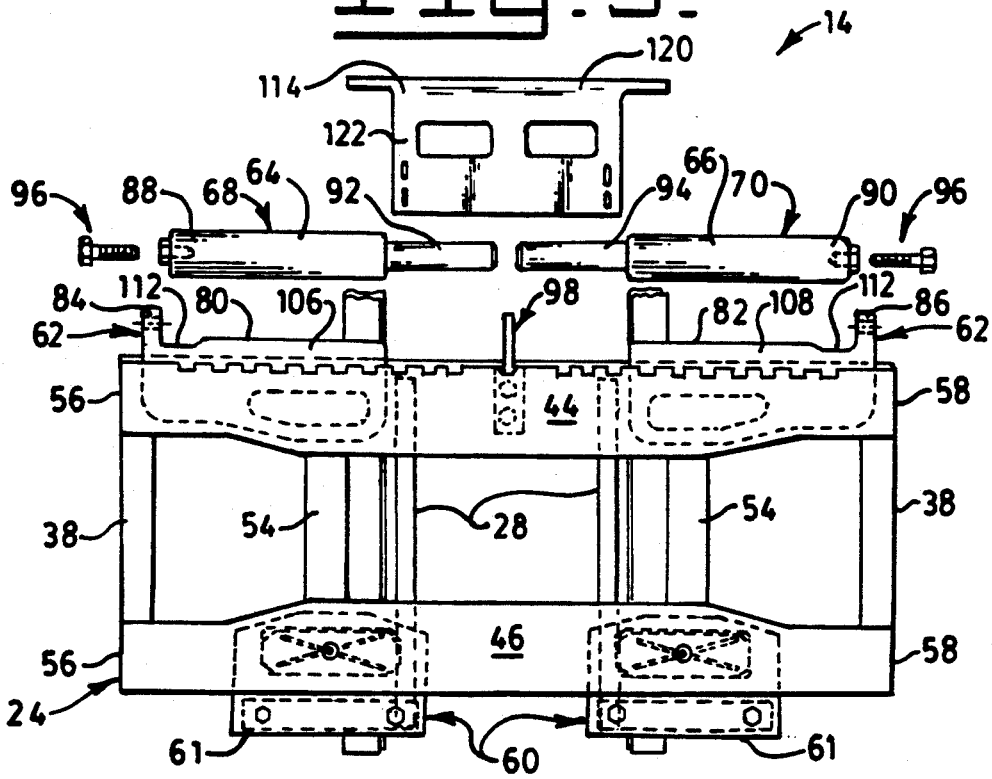
FIG. 5 is a diagrammatic front, partially exploded elevational view of the carriage assembly showing the jacks and restraining member removed.
Figure 6:
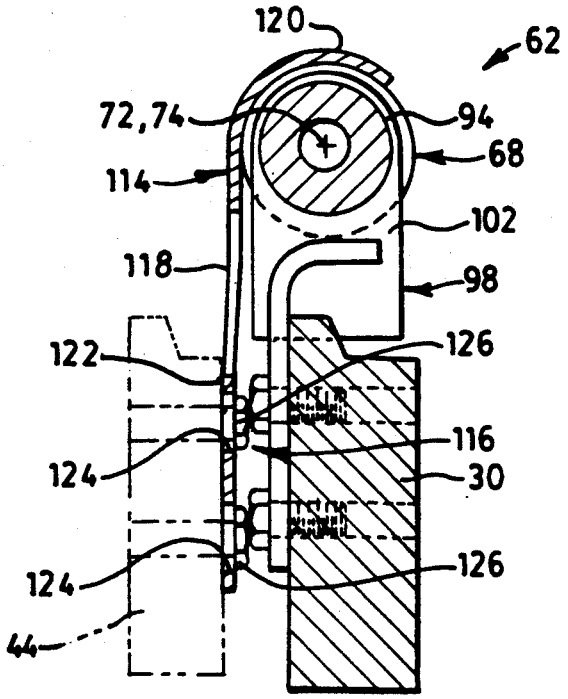
FIG. 6 is a diagrammatic cross sectional view taken along lines 6—6 of FIG. 4 show reaction means, restraining member, and one of the jacks in greater detail.
Figure 7:
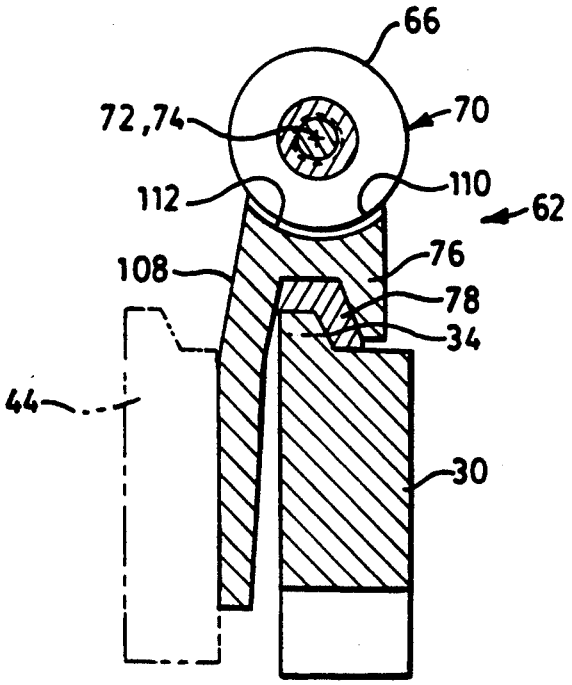
FIG. 7 is a diagrammatic cross sectional view taken along lines 7—7 of FIG. 4 showing the bracket means and one of the jacks in yet greater detail.

The side shiftable carriage assembly 14 includes a carriage frame 22, a side shift frame 24, and a pair of forks 26 slidably connected to the side shift frame 24. As best seen in FIGS. 2 and 3, the carriage frame 22 has a pair of spaced apart elevationally oriented roller brackets 28 which are disposed between the pair of uprights, 16 and rollingly engaged with the flanges of the uprights 16 so as to guide the side shiftable carriage assembly 14 for smooth elevational operation along the uprights 16. The roller brackets 28 are rigidly connected to first and second elevationally spaced elongated guide rail members 30,32, such as by welding, and maintain the first and second elongated guide rail members, and particularly the bearing surface portions 34,36 thereof, parallel to each other in directions transverse relative to the upright pair 16. A pair of stiffeners 38, located adjacent spaced apart ends 40,42 of the first and second elongated guide rail members 30,32, are connected to and between the elongated guide rail members 30,32.

The side shift frame 24 has first and second elongated elevationally spaced apart support rails 44,46 and have a bearing surface portions 48,50, respectively, which are substantially parallel to each other. The pair of forks 26 are slidably mounted on the first and second elongated support rails 44,46 and engageable with the bearing surface portions 48,50. Hook-like members 52 mounted at spaced apart locations on the forks 26 retain the forks 26 on the first and second elongated support rails 44,46 and guide the forks 26 along the bearing surface portions 48,50 in directions transverse relative to the uprights 16. A pair of spaced apart vertical supports 54 are connected to and between the first and second elongated support rails 44,46 and maintain the first and second elongated support rails 44,46 and particularly the bearing surface portions 48,50 thereof substantially parallel to each other. The first and second elongated support rails each have spaced ends 56,58 which establish the extremes of elongation of the first and second support rails 44,46 and define a substantially rectangular shaped side shift frame 24.

A pair of slider bearing assemblies 60 are disposed between the second elongated support rail 46 and the second elongated guide rail members 32 and provide low friction sliding motion between the support 32 and guide rail members 46. It is to be noted that the slider bearing assemblies 60 each have a hook like end portion 61 which wraps around the bearing surface portion 36 of the second elongated guide rail member 32 and engages the bearing surface portion 36. This retains the side shift frame 24 on the carriage frame 22 and from separation therefrom.

Referring to FIGS. 1-7, a bracket means 62 is provided for slidably connecting the side shift frame 24 to the carriage frame 22 and releasably connecting housings 64,66 of first and second jacks 68,70 to the side shift frame 24 at spaced apart locations along the first elongated support rail member 44.

The bracket means 62 maintains the bearing surface portion 34 of the first elongated guide rail member 30 substantially parallel to the bearing surface portion 48 of the first elongated support rail member 44 in the transverse directions. The bracket means 62 also maintains a longitudinal axis 72,74 of the first and second jacks 68,70, respectively, substantially in axial alignment with each other and substantially parallel to the transverse orientation of the bearing surface portion 34 of the first elongated guide rail member 30.

The bracket means 62 includes a hooking portion 76 which is connected to the side shift frame 24, hookingly connected to the carriage frame 22, and slidably movable along the first elongated guide rail member 30 of the carriage frame 22. The bracket means 62 and the first elongated guide rail member 30 guides the side shift frame 24 for movement in the directions transverse the lift mast uprights 16.

A bearing means 78 of any suitable material, for example, an ultra high molecular weight polymer or steel backed brass or bronze material, is disposed between the hooking portion 76 and the bearing surface portion 34 of the first elongated guide rail member 30. The bearing means 78 guides the side shift frame 24 along the first elongated guide rail member 30 in the aforementioned transverse directions relative to the pair of uprights 16. The combination of the hook-like end portion 61 and the hooking portion 76 maintains the side shift frame 24 on the carriage frame 22 and prevents inadvertent separation therefrom. The bearing means 78 reduces the friction between the hooking portion 76 and the bearing surface portion 34 and insures smooth, bind free sliding of the side shift frame 24 along the first elongated guide rail member 30. The bearing means 78 is retained transversely in position on the bearing surface portion 34 of the first elongated guide rail member 30 by a plurality of equally spaced apart notches disposed in the bearing surface portion 34 and a plurality of mating protrusions on the bearing means 78. Since the first elongated guide rail member 30 and the first elongated support rail member 44 are substantially the same length, and the hook-like end portions 61 and hooking portions 76 are transversely spaced apart a substantial distance from each other, the potential for cocking of the side shift frame 24 relative to the carriage frame is prevented.

The bracket means 62 includes first and second spaced support portions 80,82 and first and second spaced stop portions 84,86. The first and second support portions 80,82 and the first and second stop portions 84,86 are connected to the first elongated support rail member 44 of the side shift frame 24 at transversely spaced apart locations on the side shift frame 24. The housings 64,66 of the first and second jacks 68,70 are supported on the first and second support portions 80,82, respectively. The housings 64,66 each have an end portion 88,90 which bears against the first and second stop portions, respectively. The end portions 88,90 are located at the end of the housings 63,66 opposite the extensible rods 92,94. The first and second jacks 68,70 are disposed between the first and second stop portions 84,86 and the rod 92 of the first jack 68 faces the rod 94 of the second jack 70.

A fastening means 96 is provided for releasably connecting the end portions 88,90 of the first and second jacks 68,70 to the first and second stop portions 84,86, respectively. The fastening means 96 maintains the first and second jacks 68,70 at a predetermined axial position between the first and second ends 40,42 of the elongated support member and in engagement with the first and second stop portions 84,86, respectively. The fastening means 96 preferably includes a threaded fastener disposed in an aperture in each of first and second stop portions 84,86 and screw threadably connected to the end portions 88,90 of the housings 64,66 of the first and second jacks 68,70. It is to be noted that the end portions 88,90 include a threaded boss to which the threaded fasteners are connected.

The first and second jacks 68,70 are preferably hydraulic jacks and rod ported (pressurized fluid flow is passed through the rod to the housing) so that movement of the hoses (not shown) connecting the rods 92,94 to a hydraulic control system (not shown) is kept to a minimum. It should be noted that the rods 92,94 are stationary and the housings 64,66 move with the side shift frame 24. Further, it is to be noted that the fluid operated jacks 68,70 are of the displacement type (has no piston) and single acting (fluid forces movement of the rod in only one direction).

A force reaction means 98 is connected to the carriage frame 22 and particularly the first elongated guide rail member 30 thereof and extends transversely relative to the first elongated guide rail member 30 from a location between the spaced apart ends 40,42 of the first elongated guide rail member 30. The location of the force reaction means 98 is preferably located midway between the spaced ends 40,42 of the first elongated guide rail member 30. The force reaction means 98 has opposite sides 100,102 and the rod 92 of the first jack is engaged with one of the opposite sides 100 and the rod 94 of the second jack 70 is engaged with the other of the opposite sides 102. The side shift frame 24 is movable along the carriage frame 22 in response to a force being applied by one of the rods 92,94 of the first and second jacks 68,70 to the force reaction means 98. The amount of extension of the rods 92,94 from the housings 64,66 determines the transverse position of the side shift frame 24 relative to the carriage frame 22. Extension of the rod 92,94 of one jack 68,70 causes forced retraction of the rod 94,92 of the other jack 70,68 as pressurized fluid flow is introduced to the one jack 68,70 and exhausted from the other jack 70,68. Forced retraction of the rod of the other jack 70,68 is achieved by releasing fluid from the other jack 70,68 during extension of the rod 92,94 of the one jack 68,70. Since both rods 92,94 bear against the force reaction means 98 movement of one jack 92,94 will result in movement of the other jack 70,68 and side shifting of the side shift frame 24 will occur. The jacks 68,70 maintain the side shift frame 24 at a centered transverse position relative to the carriage frame 22 when the fluid in the jacks 68,70 is blocked from being exhausted therefrom at the control valve (not shown).

The bracket means 62 preferably includes first and second flanges 106,108, which are formed by casting, connected at spaced apart locations to the first elongated support rail member 44 of the side shift frame 24. The first and second flanges 106,108 are preferably welded to the first elongated support rail member 44, but may be attached in other manners, such as by threaded fasteners. The first support and stop portions 80,84 are connected to the first flange 106 and the second support and stop portions 82,86 are connected to the second flange 108. The first support and stop portions 80,84 are substantially perpendicular to each other and the second support and stop portions 82,86 are substantially perpendicular to each other.

The first and second support portions 80,82 each include an arcuate shaped cradle portion 110 which extends substantially parallel to the bearing surface portion 48 of the first elongated support rail member 44 in the transverse direction of extension of the first elongated support rail member 44. The arcuate shaped cradle portions 110 of the first and second support portions 80,82 engage the housings 64,66, respectively, and support the housings 64,66 of the first and second jacks 68,70 at the axially aligned positions. A relief 112 disposed in the first and second flanges 106,108 at a location adjacent the stops 84,86 provides for clearance between the housings 64,66 at the end portions 88,90 of the housings 64,66. The arcuate shaped cradle portions 110 are preferably generated by a radius about the axis 72,74 of the jacks 68,70 and have the same radius as that of the cylindrical housings 64,66.

A restraining member 114 is connected to the first elongated guide rail member 44 of the side shift frame 24 and engages the housings 64,66 of the first and second jacks 68,70. The restraining member 114 maintains the housings 64,66 on the arcuate shaped cradle portions 110 of the first and second support portions 80,82 and from radial movement relative to the first and second support portions 80,82. Adjustment means 116 adjustably connects the restraining member 114 to the side shift frame 24 and facilitates adjustable movement of the restraining member 114 in directions radially relative to the housings 64,66 of the first and second jacks 68,70.

The adjustable connecting means 116 includes a plate 118 having a curved portion 120 and a straight portion 122. A plurality of parallel elongated slots 124 are disposed in the straight portion 122 of the plate 118 and a plurality of threaded fasteners 126 are disposed in the slots and screw threadably connected to the side shift frame 24. The threaded fasteners 126 permits adjustable movement of the restraining member 114 so that the curved portion 120 may be moved into forced engagement with the housings 64,66. Securing the threaded fasteners 126 tightly against the straight portion 122 retains the curved portion 120 of the plate 118 in any radial position desired relative to the housings 66,64.

The first and second spaced support portions 80,82 and first and second stop portions 84,86 support the first and second jacks 68,70 at a location closely adjacent the bearing surface portions 34,48 so that the area of visual obstruction is kept to a minimum.

INDUSTRIAL APPLICABILITY

With reference to the drawings, and in operation, the side shiftable carriage assembly 14 enables the vehicle 10 operator to quickly, carefully and accurately position the side shift carriage frame 24 transversely relative to the uprights 20 so that a load may be acquired or deposited without any wasted time or effort.

The bracket means 62 enables the side shift carriage frame 24 to be connected to the carriage frame 22 and guides the side shift frame for movement in directions transverse the uprights 16. Due to the substantial spacing between hooking portions 76 and the substantial spacings between the hook like end portions 61 of the slider bearing assemblies 60 the potential for cocking of the side shift frame 24 is substantially reduced. Further, the addition of the bearing means 78 between the hooking portions 78 and the bearing surface portion 38 of the first elongated guide rail member 30 reduces friction and drag and thus facilitates reduced effort operation.

The first and second support portions 80,82 and the first and second stop portions 84,86 of the bracket means 62 support the first and second jacks 68,70 closely adjacent the bearing surface portions 34,48 of the first elongated guide and support rail members 30,44, respectively, and improve the window of visibility of the operator through the side shiftable carriage assembly 14.

The provision of the arcuate cradle portions 110 at the first and second support portions 80,82, the first and second stop portions 84,86 and the fastening means 96 facilitates ease of removal and installation of either or both of the first and second jacks 68,70. Also, the cradle portions 110 hold the jacks 68,70 in position during assembly so that the fastening means 96 may secure the jacks 68,70 to the adjacent stop portion 80,82. The cradle portions 110 also serves to substantially align the axes 72,74 of the jacks 68,70 so that proper operation of the jacks 68,70 may be achieved. Substantial axial alignment is achieved when the jacks 68,70 are supported in the cradle portions 110. Absolute alignment of the axes 72,74 is not necessary to achieve acceptable operation. A tolerance range of + or −3 mm (+ or −0.125 in.) is be considered acceptable and within the limits of substantial axial alignment. Since the rod ends of the jacks 68,70 face each other resistive forces of one jack 68 against the other 70 tends to reduce the loading on the force reaction means 98. Thus, the life of the force reaction means 98 is increased and premature wear and failure are prevented.

Since the rods 92,94 are free from connection to the reaction means 98 the potential for bending and side loading of the rods 92,94 is adverted. The restraining member 114 urges the housings 64,66 of the jacks 68,70, respectively, against the cradles 110 and thus permits the rods 92,94 of the jacks 68,70 from being physically connected to the reaction means 98. The adjustment means 116 facilitates control of the amount of radial load on the housings 64,66 so that the desired operation characteristics may be achieved.

Due to the above construction removal and installation of the jacks 68,70 is achieved quickly and easily and without careful and time consuming adjustments.

Other aspects, objects and advantages of the present invention can be obtained from a study of the drawings, the disclosure and appended claims.

We claim:

1. A side shiftable carriage assembly for a lift mast having a pair of spaced elevationally oriented uprights, comprising:

a carriage frame having a first elongated guide rail member and being connectable to and elevationally movable along the pair of uprights, said first elongated guide rail member having spaced apart ends and said first elongated guide rail member extending transversely relative to the pair of uprights;

a side shift frame having a first elongated support rail member;

first and second fluid operated jacks each having a housing, a rod slidably disposed in each of the housings, and a longitudinal axis;

bracket means for slidably connecting the side shift frame to the carriage frame and for releasably connecting the housings of the first and second jacks to the side shift frame at spaced apart locations along the first elongated support rail member, said bracket means maintaining the first elongated guide rail member substantially parallel to the first elongated support rail member and the longitudinal axis of the first and second jacks substantially in axial alignment with each other and substantially parallel to the first elongate guide rail member; and force reaction means connected to and extending from the carriage frame at a location between the spaced apart ends of said first elongated guide rail member, said force reaction means extending in a direction transverse relative to a direction of orientation of the first elongated guide rail member, said force reaction means having opposite sides and said rod of the first jack being engaged with one of the sides and the rod of the second jack being engaged with the other of the sides, said side shift frame being moveable along the carriage frame in response to a force being applied by one of the rods of the first and second jacks to the force reaction means.

2. A side shiftable carriage assembly, as set forth in claim 1, wherein said bracket means includes a hooking portion connected to the side shift frame, hookingly connected to the carriage frame, and slidably movable along the first elongated guide rail member of the carriage frame, said bracket means and first elongated guide rail member guiding said side shift frame for movement in directions transverse the lift mast uprights.

3. A side shift carriage assembly, as set forth in claim 2, including bearing means disposed between the hooking portion and first elongated guide rail member, said bearing means guiding said side shift frame along the first elongated guide rail member in said transverse directions.

4. A side shiftable carriage assembly, as set forth in claim 1, wherein the first and second jack housings each have an end portion and said bracket means includes first and second spaced support portions and first and second spaced stop portions, said first and second support portions and first and second stop portions being connected to the first elongated support rail member of said side shift frame at transversely spaced apart locations on said side shift frame, said housings of the first and second jacks being radially supported on the first and second support portions, respectively, and said housing end portions of the first and second jacks bearing against the first and second stop portions, respectively.

5. A side shift carriage assembly, as set forth in claim 2, wherein the first elongated support rail member of said side shift frame has spaced apart ends and including fastening means for releasably connecting the end portion of the housing of the first and second jacks to the first and second stop portions, respectively, said fastening means maintaining the first and second jacks at predetermined axial locations between the spaced apart ends of the first elongated support rail member.

6. A side shift carriage assembly, as set forth in claim 4, wherein the first and second support portions each include an arcuate shaped cradle portion, said arcuate shaped cradle portions supporting the housings of the first and second jacks at said substantially axially aligned positions.

7. A side shift carriage assembly, as set forth in claim 6, wherein said first and second support portions each have a relief portion adjacent the stop portions.

8. A side shift carriage assembly, as set forth in claim 4, including a restraining member connected to the side shift frame and engaging the housings of the first and second jacks, said restraining member maintaining the housings on the first and second support portions and from radial movement relative to the axes and the support portions.

9. A side shift carriage assembly, as set forth in claim 8, including means for adjustably connecting the restraining member to the side shift frame and facilitating movement of the restraining member in directions radially relative to the axes of the housings of the first and second jacks.

10. A side shift carriage assembly, as set forth in claim 9, wherein said adjustable connecting means includes a plate having a curved portion, a straight portion, and a plurality of parallel elongated slots disposed in the straight portion, a threaded fastener is disposed in each of the elongated slots and screw threadably connected to the side shift frame.

11. A side shift carriage assembly, as set forth in claim 4, wherein said first elongated support and guide rail members each have a bearing surface portion, said first and second support portions and first and second stop portions supporting the first and second jacks at a location closely adjacent said bearing surface portions.

12. A side shift carriage assembly, as set forth in claim 11, wherein the bracket means includes first and second flanges connected at spaced apart locations to the first elongated support rail member of the side shift frame, said first support and stop portions being connected to the first flange and said second support and stop portions being connected to the second flange.

13. A side shift carriage assembly, as set forth in claim 4, wherein said first and second stop portions and said first and second support portions extend in directions substantially perpendicular to each other.

14. A lift mast having a pair of spaced elevationally oriented uprights, comprising:

a carriage frame having a first elongated guide rail member and being connected to and elevationally movable along the upright pair, said first elongated guide rail member having spaced apart ends and said first elongated guide rail member extending transversely relative to the pair of uprights;

a side shift frame having a first elongated support rail member;

first and second fluid operated jacks each having a housing, a rod slidably disposed in each of the housings, and a longitudinal axis;

bracket means for slidably connecting the side shift frame to the carriage frame and releasably connecting the first and second jack housings to the side shift frame at spaced apart locations along the first elongated support rail member, said bracket means maintaining the first elongated guide rail member substantially parallel to the first elongated support rail member and the first and second jacks longitudinal axis substantially in axial alignment with each other and substantially parallel to the first elongate guide rail member, said bracket means having first and second transversely spaced apart support portions and first and second spaced apart stop portions, said first and second jacks being releasably connected to the first and second stop portions, respectively, and supported on said first and second support portions, respectively; and force reaction means connected to the carriage frame and extending from a location between the spaced apart ends of said first elongated guide rail member in a direction transverse relative to the first elongated guide rail member, said force reaction means having opposite sides and said first jack rod being engaged with one of the opposite sides and the second jack rod being engaged with the other of the opposite sides, said side shift frame being moveable along the carriage frame in response to a force being applied by one of the rods to the force reaction means.

15. A lift mast, as set forth in claim 14, including a restraining member connected to the side shift frame and engaging the first and second jack housings, said restraining member maintaining the housings on the first and second support portions and from movement radially relative to the jack axes.

16. A lift mast, as set forth in claim 14, wherein said bracket means includes a hooking portion hookingly connected to the side shift frame and slidably movable along the first elongated guide rail member of the carriage frame, said bracket means and first elongated guide rail member guiding said side shift frame for movement in directions transverse the lift mast uprights.

17. A lift mast, as set forth in claim 14, wherein the first and second support portions each shaped cradle portions supporting the first and second shaped cradle portions supporting the first and second jacks at said substantially axially aligned positions.

* * * * *

UNITED STATES PATENT AND TRADEMARK OFFICE

CERTIFICATE OF CORRECTION

PATENT NO. : 5,147,171

DATED : September 15, 1992

INVENTOR(S) : Kenneth R. Murray and William T. Yarris

It is certified that error appears in the above-identified patent and that said Letters Patent is hereby corrected as shown below:

Claim 1, column 9, line 19, delete "a" and insert --the--.

Claim 10, column 10, line 26, delete "screw threadably" and insert --screwthreadably--.

Claim 17, column 12, line 16, after "each" insert --include an arcuate--.

Claim 17, column 12, line 17, delete "portions" and insert --portion, said arcuate shaped cradle portions-- and delete "shaped cradle", line 18, delete "portions supporting the first and second".

Signed and Sealed this

Twenty-eighth Day of September, 1993

*Attest:*

Bruce Lehman

BRUCE LEHMAN

*Attesting Officer*

*Commissioner of Patents and Trademarks*